United States Patent [19]

Samples et al.

[11] Patent Number: 4,626,638

[45] Date of Patent: Dec. 2, 1986

[54] OPERATING SYSTEM FOR REMOTE ELECTRICAL EQUIPMENT

[75] Inventors: Billy G. Samples; Ralph L. Newton, both of Tucker; Steven A. Kaufman, Decatur, all of Ga.

[73] Assignee: Siemens Energy & Automation, Inc., Atlanta, Ga.

[21] Appl. No.: 678,719

[22] Filed: Dec. 6, 1984

[51] Int. Cl.[4] ..... H01H 3/02; H01H 9/22

[52] U.S. Cl. ..... 200/331

[58] Field of Search ..... 200/331, 334, 337, 338; 174/471 R, 502

[56] References Cited

U.S. PATENT DOCUMENTS

| | | | |
|---|---|---|---|
| 2,930,940 | 3/1960 | Trumpler | 317/99 |
| 3,385,938 | 5/1968 | Schockett | 200/50 |
| 3,939,725 | 2/1976 | Fisher | 74/503 |
| 3,987,268 | 10/1976 | Maeda | 219/10.49 |
| 4,150,264 | 4/1979 | Lieberman | 200/51 LM |
| 4,374,597 | 2/1983 | Mochida | 74/471 R |
| 4,400,599 | 8/1983 | Rickmann | 200/50 C |
| 4,419,549 | 12/1983 | Osborne | 200/50 A |
| 4,526,057 | 7/1985 | Mochida et al. | 74/471 R |

FOREIGN PATENT DOCUMENTS

| | | | |
|---|---|---|---|
| 930780 | 7/1973 | Canada | 200/331 |

*Primary Examiner*—Stephen Marcus
*Assistant Examiner*—Renee S. Luebke
*Attorney, Agent, or Firm*—F. W. Powers; J. L. James

[57] ABSTRACT

A system for operating electrical equipment such as circuit breakers from a remote point is disclosed. A flexible push-pull type cable connects a linkage coupled to a pivoted handle and to a remote slider mechanism. The slider serves as a slave operator to effect reciprocation of a handle or similar operator element.

5 Claims, 4 Drawing Figures

OPERATING SYSTEM FOR REMOTE ELECTRICAL EQUIPMENT

BACKGROUND OF THE INVENTION

The present invention relates to operating mechanisms for electrical apparatus, and more particularly to mechanical means for operating an electrical device which has a reciprocating element and which may be disposed in a variety of positions remote from an operator.

Related apparatus are disclosed in copending patent applications Ser. Nos. 656,174 and 655,875, filed Sept. 28, 1984.

Many forms of enclosed electrical apparatus include a circuit controlling or interrupting mechanism, in some cases taking the form of a molded case circuit breaker. Molded case breakers are convenient for installing in cabinets and the like, since they comprise an integrated assembly within a solid casing molded from phenolic resin or the like. Since the breaker is a self-contained unit, in order to install it in equipment it only needs to be attached to an appropriate mounting structure, such as a bracket or wall within the apparatus, and the necessary leads or wires attached to its terminal.

The operation of such a breaker is quite simple, inasmuch as such breakers are typically provided with toggle-type handles. Indeed, it is ordinarily intended that the molded case circuit breaker be operated directly by hand, and for this reason no special toggle or other operator is provided, although the manufacturer of the circuit breaker normally supplies, as a purchase option, means for operating it remotely.

In some forms of apparatus, such as motor control centers, it is required that the molded case breaker be contained within a metal cabinet and interlocked so that the cabinet cannot normally be opened when the breaker is on and the equipment within the cabinet energized. For this reason it is frequently desireable to place the breaker deep within the cabinet, while having on the cabinet door or on a stationary portion of the cabinet a hand-actuated mechanism which operates, through a linkage or otherwise, the breaker within. In this manner the breaker can be operated from without the cabinet by moving a lever or handle.

Although in principle this approach is quite straightforward, much ingenuity and engineering effort has gone into providing rugged, easy manufacturable operating assemblies which are usable with a variety of different molded case breakers. For instance, U.S. Pats. Nos. 3,358,094-Metz and 3,229,056-Turnbull show various approaches to providing such operator assemblies.

One problem which has been prevalent with prior operating mechanisms is that the arms, linkages or other elements require a particular geometric configuration and spatial relationship of the outer operator handle to the inner, molded case breaker. Ordinarily such operators take the forms of linkages, pivoted arms, and/or sliding elements which are constrained to move in a limited manner. It will therefore be appreciated that it would be highly advantageous to provide an improved system for operating a molded case circuit breaker from a remote position and which can be disposed at any one of a number of positions remote from the breaker itself, yet without requiring special reconstruction, modification or adaptation.

It is therefore an object of the present invention to provide an improved remote operating system for a molded case circuit breaker or the like.

It is another object of the present invention to provide a remote operating system for electrical apparatus, which can easily be mounted at a variety of different positions with respect to the controlled apparatus.

Yet another object is to provide a remote operating apparatus for simultaneously controlling an electrical mechanism and an interlock.

SUMMARY OF THE INVENTION

Briefly stated, in accordance with one aspect of the invention the foregoing objects are achieved by providing a slave operator which is coupled to a control device such as a circuit breaker within an enclosure, and a master operator disposed outside the enclosure. A flexible cable connects the master and slave operators together. Means are provided on both the master and the slave operator for securing the cable sheath, while the operating member of the cable is coupled to the movable portions of master and slave operators so that by moving an external handle on the master operator, the circuit breaker can be switched on or off, or reset.

In the further embodiment of the invention a second flexible cable is coupled at a first end to the master operator, while a second end is connected to and actuates another mechanism such as a door latch, interlock with another electrical device or remote position indicator simultaneously with the circuit breaker toggle when the operating handle is moved from one position to another. With one modification of the latter embodiment, the first end of the second flexible cable is coupled to the slave operator, so that operation of another mechanism is accomplished directly from the movement of the slave operator.

BRIEF DESCRIPTION OF THE DRAWINGS

While the specification concludes with claims particularly pointing out and distinctly claiming the subject matter which is regarded as the invention, it is believed that the invention will be better understood from the following description of the preferred embodiments taken in conjunction with the accompanying drawings in which:

DESCRIPTION OF A PREFERRED EMBODIMENT

Figure 1:
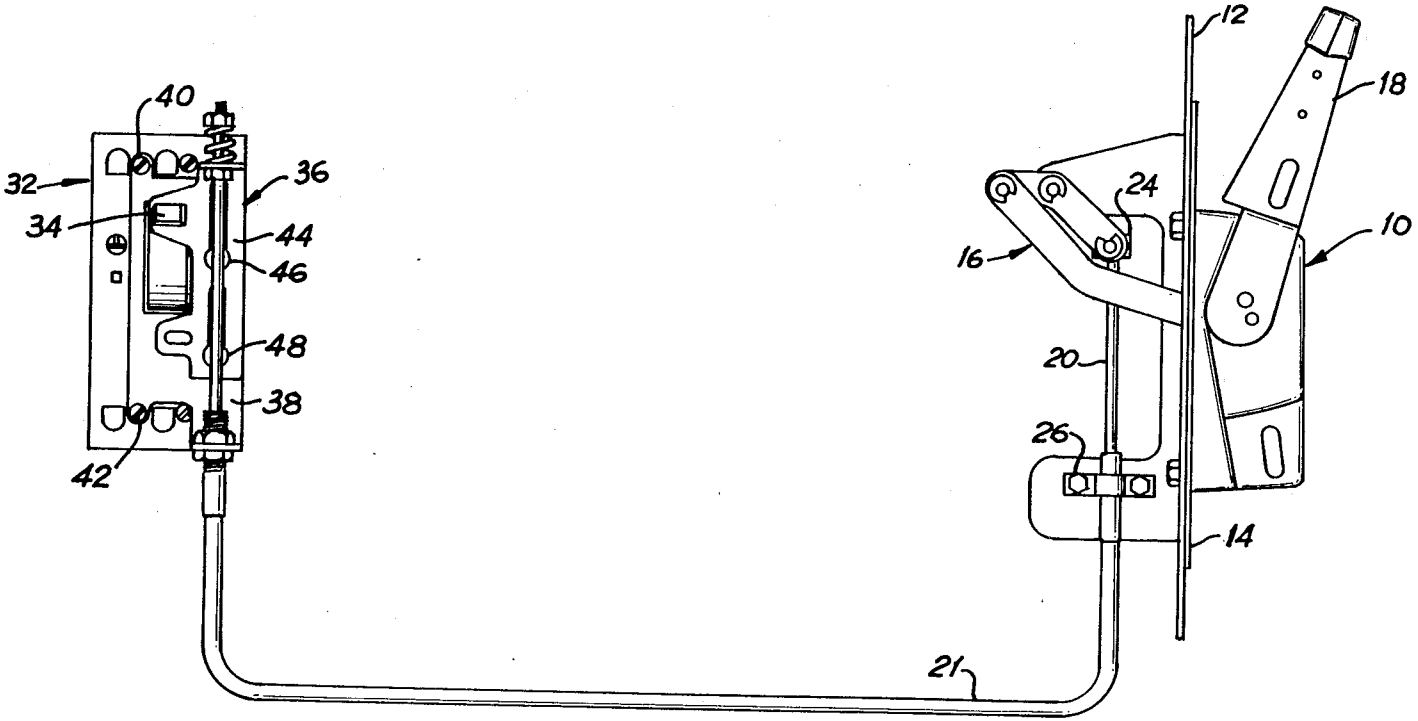
FIG. 1 illustrates one embodiment of the invention whereby a slave operator is operated by a remote handle.

In FIG. 1 there is shown a master operator assembly generally indicated at 10. The operator assembly is mounted upon the wall of a sheet metal enclosure 12 in the usual fashion, or as a separate unit, mounted externally on or away from the enclosure and generally comprises a fixed portion 14, an internal linkage 16 and a handle 18. The specific construction of a master operator suitable for use with the present invention is disclosed in more detail in copending application Ser. No. 655,875 filed Sept. 28, 1984.

The handle assembly allows the operating member 20 of flexible cable 21 to be coupled to a linkage 16 by fixture 24. A clamping bracket 26 secures the outer sheath of the flexible cable to the fixed or stationary portion of the handle assembly.

At the distal end of the cable, and mounted within the enclosure, is an electric apparatus 32 which may for example be a molded case circuit breaker of the type having a handle 34 which is intended to be grasped manually and translated up and down to turn the unit on or off, or to reset the breaker after it has tripped.

A slave operator for manipulating the breaker is generally denominated 36 and comprises a stationary member 38 which is affixed to the front surface of the breaker by machine screws 40, 42. A second, moveable portion or slider 44 of the slave operator is slidingly attached to the stationary portion by retaining means such as rivets 46 and 48. An opening at the side of the moveable portion encaptures handle 34, so that the latter is moved up and down as the sliding member is reciprocated.

Clamped to a tab at the lower end of the stationary member 38 is the sheath of the flexible cable. The operating member of the cable extends upwardly and is secured to a similar tab at the upper end of slider 44. This aspect of the construction, and the operation of the slave unit, is more specifically set forth in copending application Ser. No. 656,174.

In operation, with handle 18 in the lowermost or "off" position the door 52 to the enclosure may be opened, and installation and repair work accomplished. (FIG. 3) With handle 18 in this position, it will be understood that linkage 16 is moved to draw the end of the cable operating member upwardly. As a result, the operating member end at the circuit breaker 32 is withdrawn into the cable sheath. Slider 44 of the slave operator 36 is thus moved downwardly, pulling with it the toggle 34 of the circuit breaker and switching the breaker off.

Figure 2:
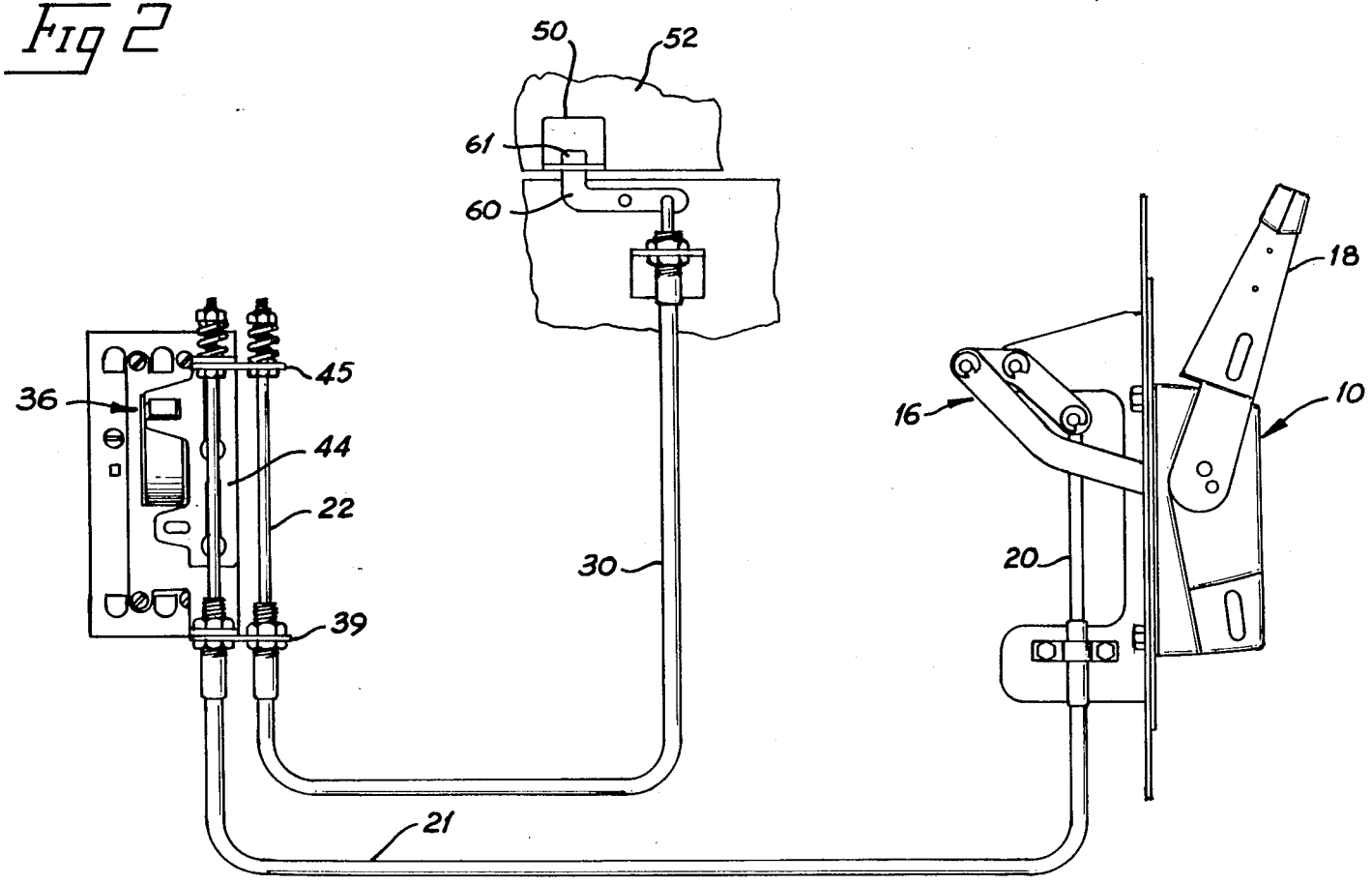
FIG. 2 illustrates another embodiment of the invention wherein a slave unit is used to operate a remote latch assembly by way of a second flexible cable.

Turning now to FIG. 2 wherein like elements are provided with the same numbers as in FIG. 1, there is shown another embodiment of the invention wherein a latching assembly is operated by the slave operator 36, rather than being driven directly from the master operator 10. With this embodiment, the stationary member 38 of the slave operator is provided with an extended lip 39 to which the sheath of a second cable assembly 30 is attached. Further, slider 44 is provided with an extended lip 45 which fixedly engages the operating member 22 of the second cable assembly for instance by means of threaded nuts, as shown.

With handle 18 in a raised or "on" position operating member 20 is pushed into its sheath, with the result that the slider 44 of slave operator 36 is pushed upwardly and the circuit breaker energized.

At the same time, the upward movement of slider 44 pulls operating member 22 upwardly, the relative motion causing the distal end to retreat into its sheath. This causes a pivoted latch member 60 to rotate in a clockwise manner so that its latching end 61 engages latch member 50.

Here it should be recognized that due to the flexibility of the second cable assembly, sheath 30 may be moved to various positions with respect to operating member 22. It should of course be recognized that the orientation of the second flexible cable could be changed so that operating member 22 is fastened to base plate 38 while its sheath is coupled to slider 44. In either case, however, the result would be the same in that the distal end of the operating member would be extended as slider 44 moves downwardly, pivoting arm 60 in a counterclockwise manner to cause it to withdraw end 61 from female latch member 50 so that door 52 can be opened when the circuit breaker is deenergized.

Figure 3:
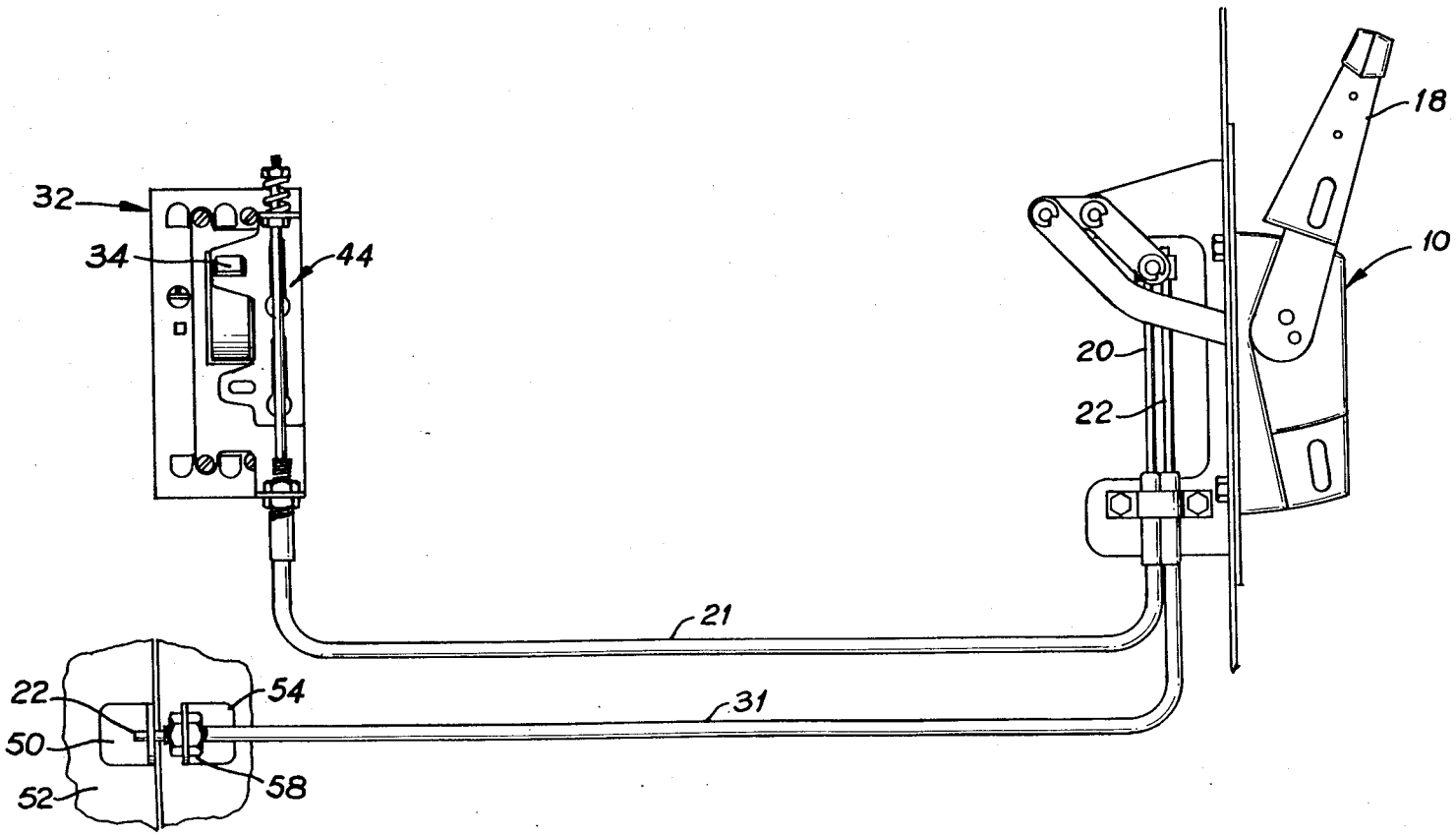
FIG. 3 illustrates a single handle operating a latch and a circuit breaker in parallel.

FIG. 3 illustrates another embodiment of the invention in which a pair of paralleled cables are operated by the handle assembly to operate two remote elements simultaneously.

As will be familiar to those skilled in the art it is preferable, and often required, that the door or panel of the enclosure in which circuit breaker 32 is located be interlocked in such a manner that it cannot ordinarily be opened when the breaker is in the "on" position. This prevents unauthorized access to the internal portions of the enclosure while the electrical elements therein are "live".

Ordinarily such interlocking has been accomplished by means of mechanical elements directly attached to the linkage of the outer handle assembly. As a consequence, the location and orientation of the handle assembly, or master operator, was largely determined by the interlock mechanism. The present invention eliminates such constraints, however, and allows the handle mechanism to be placed at a convenient position without regard to the interlock position. In the Figure a simple interlock is shown comprising a female latch member 50 which is disposed on a door or removable panel 52. A confronting support 54 is fixedly attached to a nearby, stationary portion of the enclosure, which may be a door jamb or frame. Coupled to support 54 by means of fastening devices such as nuts 58 is the distal end of a second cable assembly 31. With the handle in the position shown and the circuit breaker in the "on" position both cable operating members are extended, so that the operating member 22 of the second cable extends through an opening in female latch member 50. This prevents the opening of door 52 until such time as the operating member is withdrawn.

When it is desired to energize the system, door 52 is closed so that the opening in female latch member 50 aligns with the operating member 22 of the second cable assembly. Handle 18 is then pushed up to the "on" position which rotates linkage 16 and pushes operating members 20, 22 downwardly, through their corresponding cable sheaths.

As a result, operating member 20 is pushed upwardly at the slave operator, forcing slider 44 upwardly and accordingly pushing toggle 34 up to the "on" position. In like manner operating member 22 is extended from sheath 30, and is urged outwardly through the mating aperture in female latch member 50 as shown in FIG. 1. In this position the latch member is engaged so that door 52 may not be opened, and breaker 32 is energized.

Figure 4:
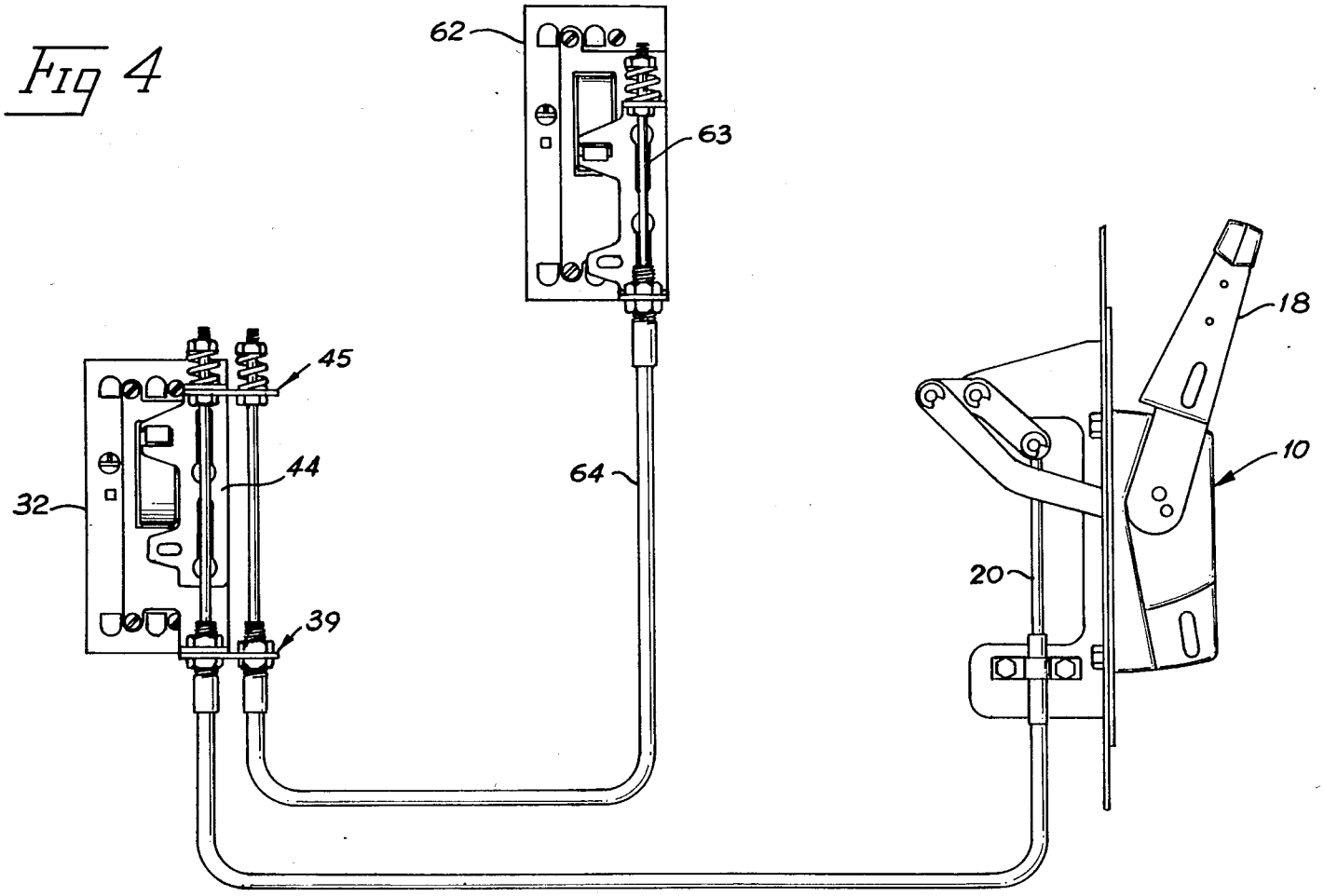
FIG. 4 shows a pair of circuit breakers coupled to series-connected slave operators.

FIG. 4 shows still another, related approach in which a pair of circuit breakers 32 and 62 are coupled in series by another cable assembly 64. Breaker 62 is provided with a slave operator 66 which is preferably identical to operator 36 of breaker 32. Tab extensions 45 and 39 allow the operating member and sheath of cable assembly 64 to be secured to slave operator 32 in the same manner as shown in FIG. 2.

Accordingly it will be understood that as handle 18 is moved upwardly, operating member 20 causes the slider of the remote operator 32 to move up, switching the breaker on. At the same time, operating member 63 of cable 64 is withdrawn from its sheath as the operating member is elevated by the upward movement of slider 44. This in turn exerts a downward force on the corresponding slider of slave operator 66 with the result that breaker 62 is switched off. This causes the two breakers to alternate so that, for instance, a first circuit maybe energized while a second circuit is simultaneously deenergized.

It will now be understood that there has been disclosed an improved system for operating a circuit breaker or other electrical apparatus remotely, from without an enclosure, and without the constraints of prior-art linkages ans similar mechanisms. In addition, the present invention provides an improved, highly adaptable arrangement for coupling an interlock system to the remote operator which allows the relative placement of the interlock and breaker to be varied in accordance with the needs of a particular application. While the remote master operator is disclosed as a manually-operated handle it will be understood that the motivation for the master operator device could be electric, hydraulic or pneumatic. It is accordingly intended that the following claims shall cover all such modifications and applications as do not depart from the true spirit and scope of the invention.

What is claimed as new and desired to be secured by Letters Patent of the United States is:

1. Apparatus for operating an electrical control device having a generally reciprocating toggle and disposed within an enclosure, comprising:

a slave operator including a fixed member adapted to be attached to the device adjacent the toggle and a movable member slidably attached to said fixed member and having an opening for receiving the toggle therein;

a master operator disposed remotely with respect to the device and having at least a handle portion extending outside the enclosure, including a movable linkage coupled to the handle portion, and a stationary portion adjacent said linkage; an a cable assembly including a sheath and an operating member, said sheath being coupled at a first end to one of said linkage and said stationary portion of said master operator and having a second end coupled to one of said fixed member and said movable member of said slave operator, said operating member having a first end coupled to the other of said linkage and stationary portion, and a second end coupled to the other of said fixed member and said movable member.

2. Apparatus as defined in claim 1, wherein said cable sheath is fixedly attached to said stationary portion of said master operator and to said fixed member of said slave operator and said operating member is coupled to said movable linkage of said master operator and to said movable member of said slave operator.

3. Apparatus as defined in claim 1, further including:

latch means adapted to be positioned within said enclosure for preventing opening of said enclosure; and a second cable assembly including a second sheath and a second operating member, said sheath having a first end coupled to one of said linkage and said stationary portion of said master operator and a second end coupled to one of said fixed member and said movable member of said latch means;

whereby operation of said master operator causes the translation of the operating member within the sheaths of said first and second cable assembly, operation of said master operator in a first direction to close an electrical circuit, and to move said latch means to secure said enclosure; movement of said master operator in a second, opposite direction effecting movement of said operating members within said first and second cable sheaths for moving said reciprocal operator in a second direction to open an electrical circuit, and moving said latch means in a direction to unlatch the enclosure.

4. Apparatus as defined in claim 1, wherein the enclosure is provided with a door for allowing access thereto, and further including latch means adapted to be mounted adjacent the door of said enclosure for securing the door closed; and a second cable assembly including a sheath having a first end coupled to one of said fixed member and said movable member of said slave operator, and the second end coupled to said latch means and a an operating member having a first end coupled to the other of said fixed member and said movable member of said slave operator, and a second end coupled to said latch means.

5. Apparatus as defined in claim 4, wherein said first end of said second cable sheath is secured to the movable member of said slave operator, and said first end of said second cable operating member is coupled to the fixed member of said slave operator.

* * * * *